US006132205A

United States Patent [19]

Harneit

[11] Patent Number: 6,132,205

[45] Date of Patent: Oct. 17, 2000

[54] MULTI-RING SEALED GAS BURNER

[76] Inventor: Uwe Harneit, 1466 W. Francis Ave., Ontario, Calif. 91762-6016

[21] Appl. No.: 09/478,420

[22] Filed: Jan. 6, 2000

[51] Int. Cl.[7] ..... F23D 14/62

[52] U.S. Cl. ..... 431/354; 431/284; 431/278; 126/39 R; 126/39 E; 239/561

[58] Field of Search ..... 431/284, 278, 431/354, 281, 355, 285, 198, 200, 264, 196; 126/39 R, 39 E, 39 K, 39 BA, 39 N, 39 J; 239/561, 560, 556, 568, 567

[56] References Cited

U.S. PATENT DOCUMENTS

| | | | |
|---|---|---|---|
| 1,716,329 | 6/1929 | Simpson . | |
| 3,597,135 | 8/1971 | Kweller et al. . | |
| 3,843,313 | 10/1974 | Hegleson . | |
| 4,313,416 | 2/1982 | Lau . | |
| 5,277,576 | 1/1994 | Hartung | 126/39 R |
| 5,295,476 | 3/1994 | Herbert . | |
| 5,401,164 | 3/1995 | Yen | 431/354 |
| 5,704,778 | 1/1998 | Hsieh | 431/354 |
| 5,842,849 | 12/1998 | Huang | 431/284 |

*Primary Examiner*—James C. Yeung
*Attorney, Agent, or Firm*—Brande & McCleary; Lewis M. Brande; Thomas A McCleary

[57] ABSTRACT

This invention incorporates a multi-ring burner assembly utilizing at least two flame rings to gently and evenly warm food and a third flame ring in conjunction with the first two flame rings for cooking food.

This design has the further advantages of easy replacement of both the igniters and the gas jets from the top of the appliance without having to remove the unit from the appliance.

8 Claims, 5 Drawing Sheets

MULTI-RING SEALED GAS BURNER

BACKGROUND OF THE INVENTION

1. Field of the Invention

Gas burners that incorporate two and three flame rings are known in the field of the art. Generally, a flame ring that is located in the center of the gas burner is designated as a warming burner. The outer flame ring and middle flame ring, if any, are designated as the main burner.

It is common for the main burner to generate a heat output greater than 10,000 Btu/hr (British thermal units per hour). The heat output generated by the warming burner, at its lowest setting, can be reduced to approximately 600 Btu/hr, without extinguishing the flame. The diameter of the flame rings determine the heat output of the burner. Since the warming burner generates a lower Btu/hr output than the main burner, the warming burner has a smaller diameter than the main burner. The warming burner is approximately ½ inch in diameter, while the main burner is approximately 4 inches in diameter.

Maximum burner output is achieved when the main burner and the warming burner are both operating at their maximum outputs. After the main burner is shut off, only the warming burner is operating, and it can be regulated by adjusting the burner valve. The purpose of the warming burner is not only to keep cooked foods warm, but also can be used to melt butter or chocolate, without browning the butter or burning the chocolate.

The disadvantage of a singular warming burner, which is located in the center of the burner assembly, is that the warming burner has a very small diameter. The heat of the warming burner is then generated over a very small area under a pot or pan, which results in uneven cooking at the lower operating temperatures.

Burners caps for this type of burner are generally designed in two pieces. Each of the separate pieces are shaped as thin concentric rings. The main burner cap has gas outlet slots or holes arranged on the sides of the burner cap, forming a ring of flame when a flammable gas is ignited. A second burner cap, which is smaller in diameter than the main burner cap (called a warming burner), also has gas outlet slots or holes arranged on the sides of the burner cap and also will form a ring of flame when a flammable gas is ignited. The caps of both the main burner and the warming burner are loosely positioned, concentrically to each other, on the top of the burner head. The disadvantage of this design is that the burner cap of the warming burner is so small in diameter that it is easily lost.

An additional disadvantage of burners designed in this manner is that the gas jets that were previously installed in the gas/air mixing tubes (called air mixers) are not accessible from the top of the appliance. In order to adjust the appliance to accommodate a different type of flammable gas, the top of the burner assembly must be removed from the appliance. The top of the appliance must also be removed in order to gain access to the gas jets.

Ignition electrodes installed in these burner assemblies have a similar drawback. The ignition electrodes are generally installed from the bottom side of the burner head, or next to the burner from the bottom of the appliance top. These drawbacks sometimes cause service personnel even greater problems, and results in higher costs for the consumer. After prolonged operation of the gas appliance, the screws, clips and other fasteners are quite difficult to loosen.

2. Description of the Prior Art

The use of a multi-ring gas burner is known in the prior art.

U.S. Pat. No. 5,295,476 describes a burner plate that has a series of concentric rings, the concentric rings each being perforated to match the arrangement of concentric chambers to provide concentric gas burning rings. Control valves regulate the flow of gas to the burner plate perforation where heat is required. This unit operates with the use of an electrical thermocouple to maintain a predetermined heat level. As the control valve is turned, a specific number of rings are ignited to provide the required heat. This invention uses a very complex valve assembly to provide the gas requirements to the burner hob.

U.S. Pat. No. 1,716,329 describes a combination gas and electric stove. The gas portion of the stove provides gas from an inner chamber to a series of perforations in the burner top. The difference between the described patent and the present invention is that the gas output to all the perforations is the same, where the present invention has a varied heat capacity over the burner cap.

U.S. Pat. No. 5,397,135 describes a commercial gas burner structure. A plurality of upright portions are mounted on a plate portion. A chamber is located below the plate portion, where passageways extend from the chamber and pass outwardly through the upright portions. The described patent has upright flame, and all the upright portions provide flame, where the present invention only has specific flame rings in operation.

U.S. Pat. No. 4,313,416 describes a heating element for a wok shaped cooking utensil. A spiraling gas tube describes a series of concentric rings, where the concentric rings have perforations that provide the requisite flame when ignited. This s patent describes an invention that provides for all the perforations to provide flame at the same time.

U.S. Pat. No. 3.843,313 describes a multi-cavity radiant burner. A series of annular cavities regulated by a valve allows a liquid flammable fuel such as gas to enter into each of the cavities where they are ignited. The three cavities are supplied progressively. First to the inner, then to the middle, and finally to the outer cavity, where the inner cavity will provide the least amount of radiant heat, and the generated heat gets progressively greater with ignition of each successive ring. This patent requires that the burner ring provide the combustion surface. By opening the valve to initiate ignition of the middle burner cavity, the inner cavity is provided with its maximum radiant capability, thereby having greater heat capacity at all levels, but not capable of good low temperature cooking.

SUMMARY OF THE INVENTION

The purpose of the present invention is to provide a burner assembly that incorporates the warming burner and the main burner as a one piece unit which will prevent easy loss or misplacement of the burner cap.

It is a further purpose of the present invention to provide an additional flame ring providing at least 2 warming flame rings located on the burner cap in order to provide additional warming capacity over a greater surface area for low temperature cooking or warming in order to prevent burning of the food.

Another purpose of the invention is to provide easy access to the gas jets from the topside of the appliance, which will not require major disassembly of the appliance.

Yet another purpose of the invention is to provide easy access to the ignition electrodes from the topside of the appliance, which will also not require major disassembly of the appliance.

The present invention consists of a one piece burner cap that incorporates both a outer burner ring and a warming burner cap. The warming burner cap is smaller in diameter than the outer burner ring and has ports on an outer perimeter of the warming burner cap, creating a warming flame ring.

The main burner cap has two edges, an inner edge and an outer edge. The inner edge of the main burner cap has ports on its perimeter, and faces the ports of the warming burner cap. The gas from these ports will create a secondary warming flame ring, which will augment the warming flame ring. The outer edge of the main burner cap has ports on its perimeter, with the ports spaced to provide enough heat to bring the output of the burner assembly to more than 10,000 Btu/hr.

The burner head assembly consists of a built up grouping of parts creating concentric rings or chambers, in which the inner most ring creates a chamber that provides a flammable gas/air mixture to the warming burner cap, a middle ring or chamber provides a flammable gas/air mixture to a secondary warming flame ring, and the outer most ring provides gas for the primary flame ring on the outer surface of the outer burner ring.

The burner base provides means to inject a flammable gas into mixture tubes, creating a flammable gas/air mixture which is then transmitted to the respective flame rings and then ignited.

DETAILED DESCRIPTION

Figure 1:
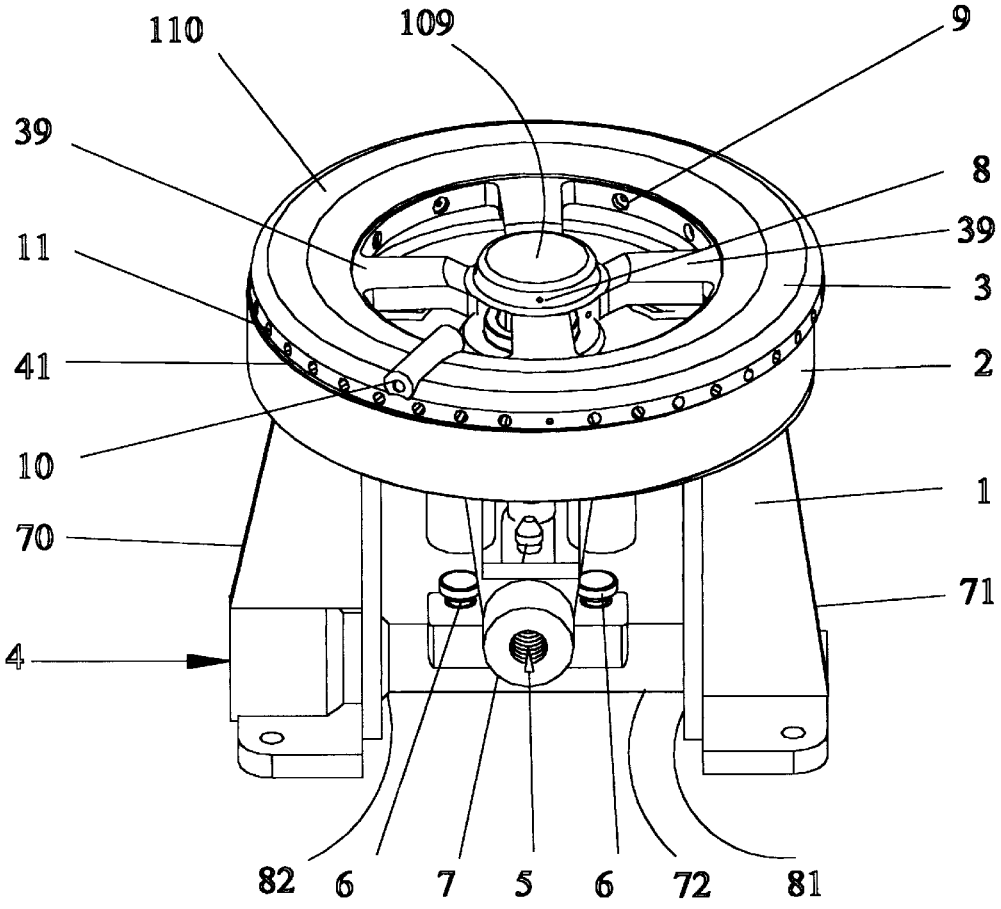
FIG. 1 shows a perspective view of a 3-flame ring burner.
Figure 2:
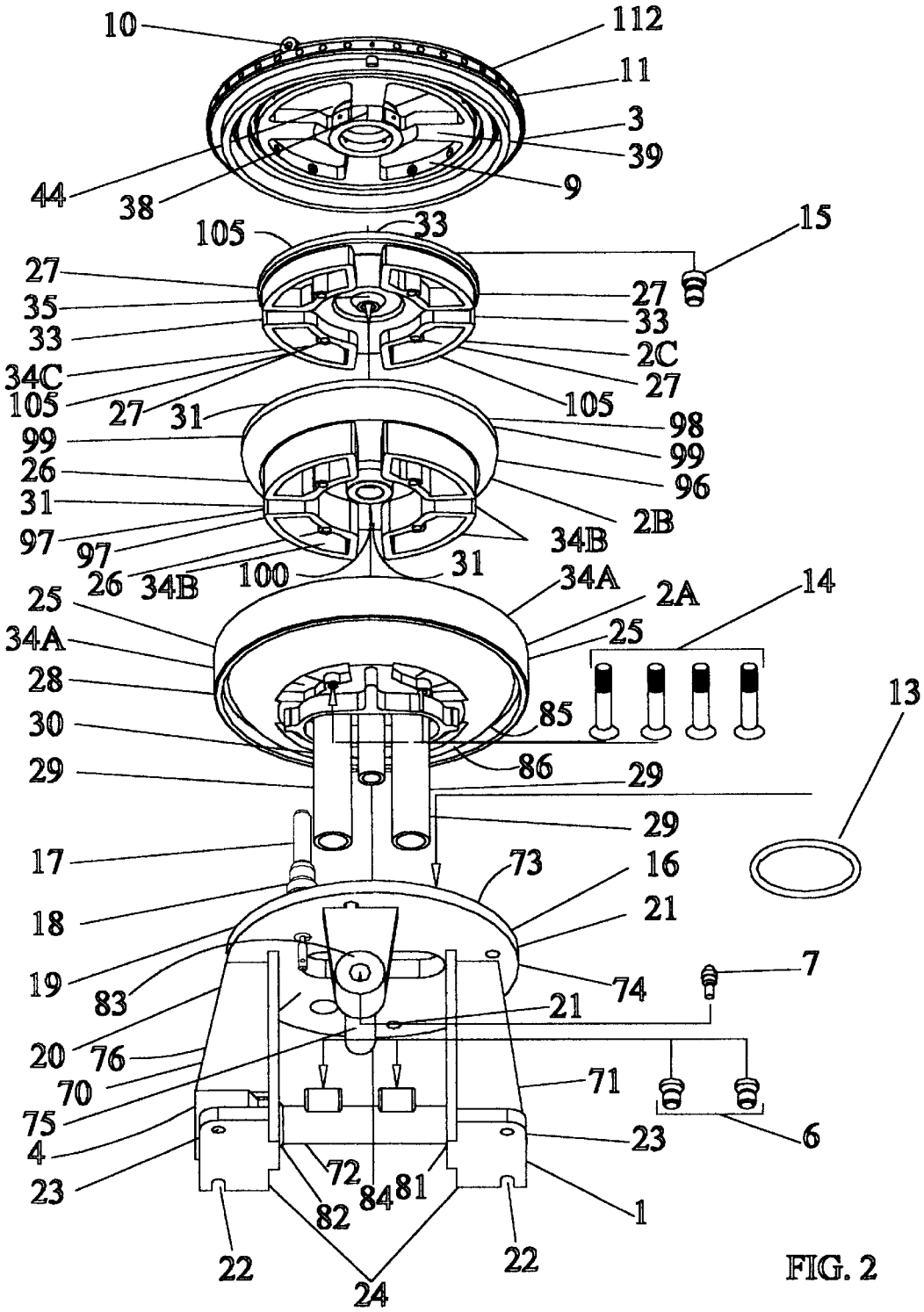
FIG. 2 shows an expanded view in order to simplify display of the individual components of a 3-flame ring burner.
Figure 3:
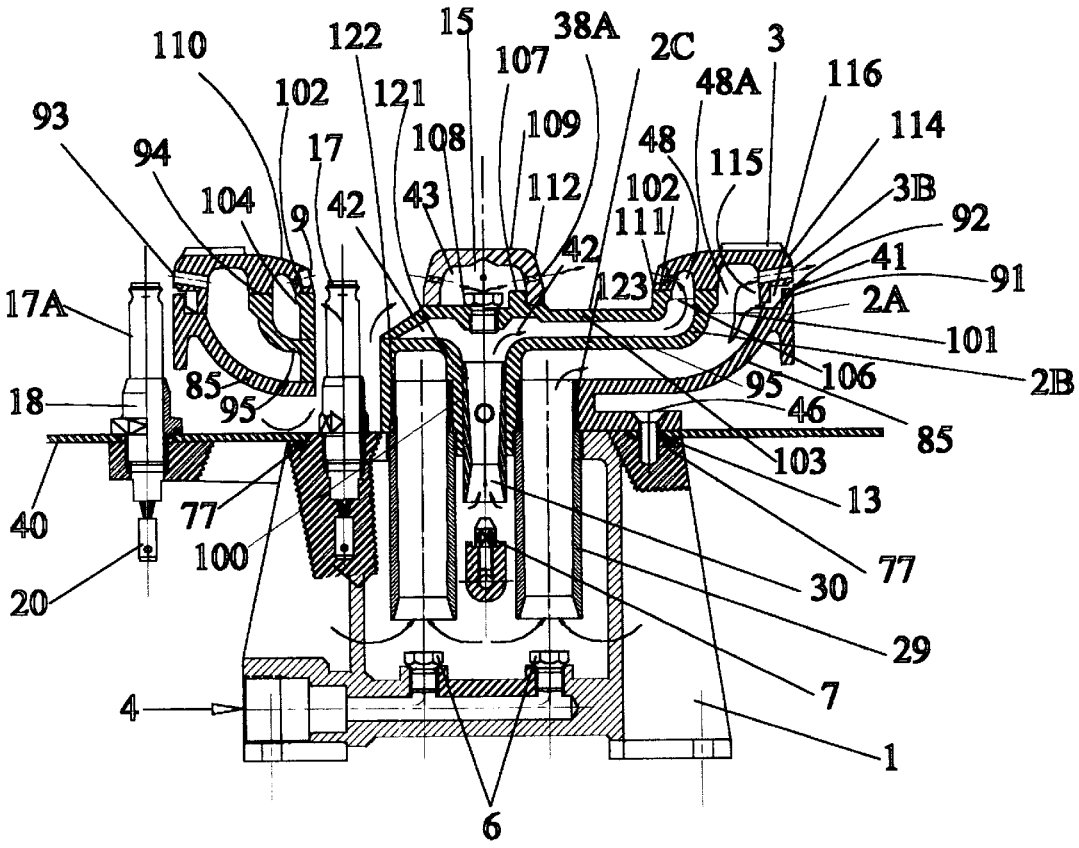
FIG. 3 shows an offset section through a 3-flame ring burner in simplified representation, in which the burner head is firmly connected to the burner base.
Figure 4:
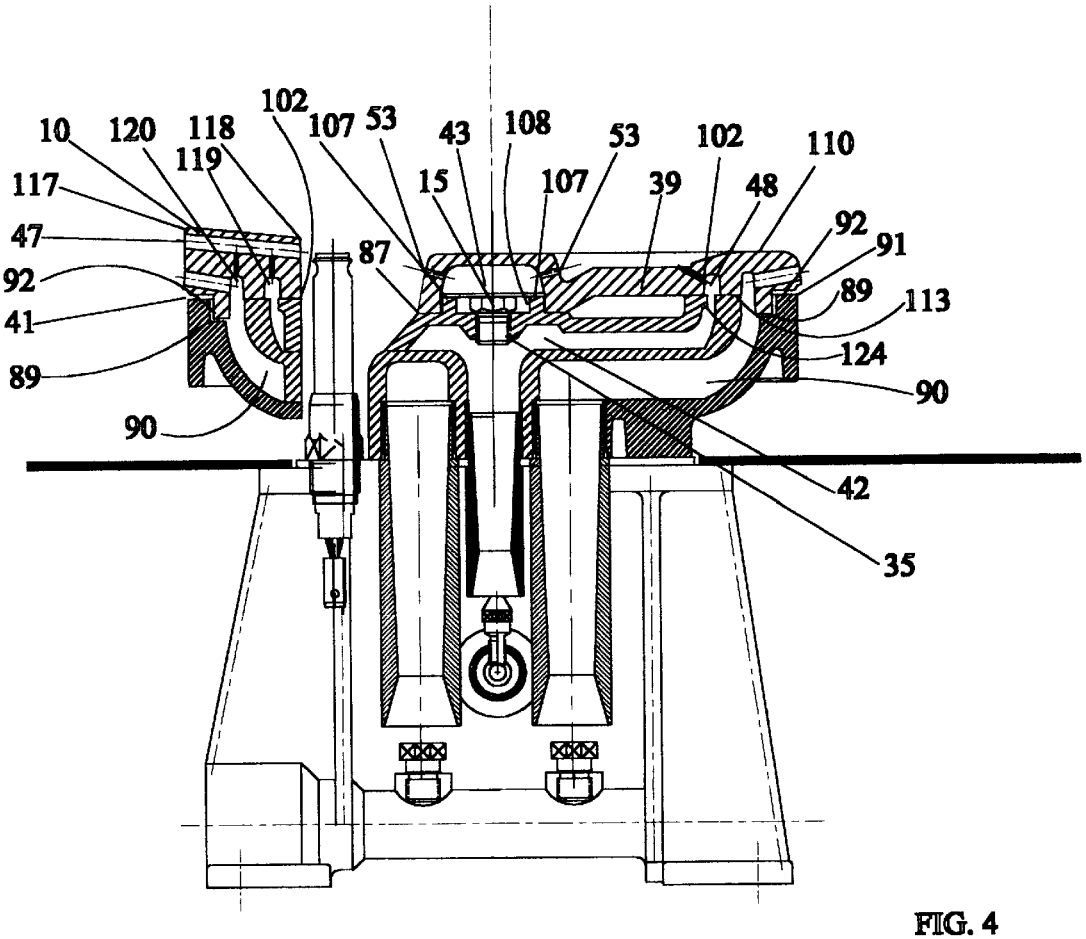
FIG. 4 shows an offset section through a 3-flame ring burner in simplified representation, in which the burner head is removable.
Figure 5:
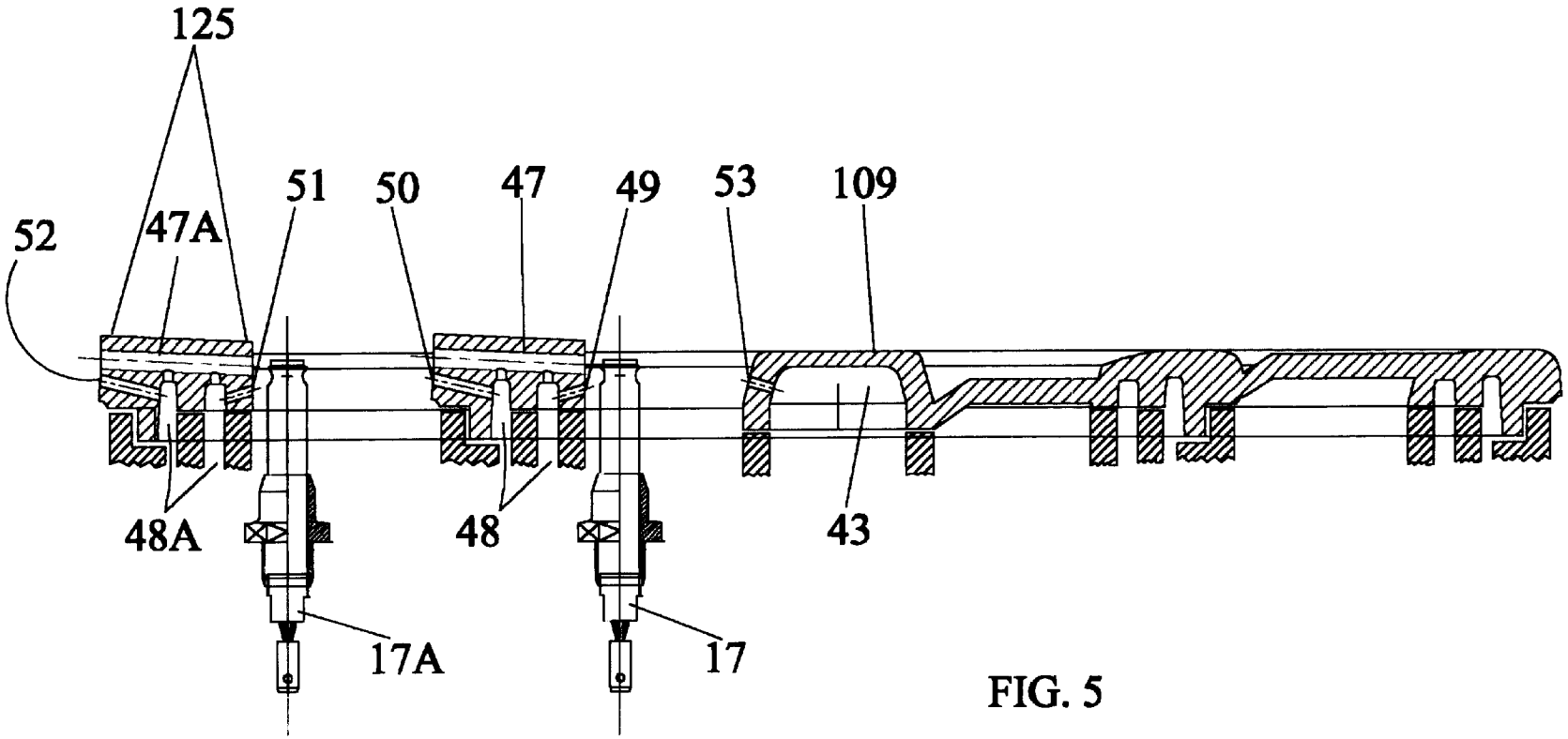
FIG. 5 shows a one-piece 5-flame ring cap in offset side section.

The burner assembly for this invention includes a burner base (1) that has a horizontal surface defining an upper platform (19), the upper platform having a lower surface (74) and an upper surface (73). The lower surface (74) of the upper platform (19) has a first burner base support (70), and a second burner base support (71) projecting downwards and terminating in a foot (24), each foot (24) being essentially in a parallel relationship with the upper (19). Each foot has plug-in slots (22) defined on an edge of the foot (24) of the first and second burner base supports (70), (71), which allow easy positioning of the burner assembly on the appliance, and each foot (24) additionally has holes (23) defined thereon. A primary gas transfer tube (72) is attached to the first and second burner base supports (70), (71). The primary gas transfer tube (72) has a first end (81) and a second end (82). The first end (81) of the primary gas transfer tube (72) is attached to the second burner base support (71), and is capped to prevent any gas from escaping. The second end (82) of the primary gas transfer tube (72) has an inlet (4) to supply flammable gas to an outer flame ring (11). In addition, the primary gas transfer tube (72) has two threaded holes spaced apart, centrally located, and facing the lower surface (74) of the upper platform (19) of the burner base (1). The primary gas jets (6) are threadably engaged into the threaded holes of the primary gas transfer tube (72). A warming gas tube (75) has a first end (83) and a second end (84). The first end (83) of the warming gas tube (75) has a warming gas inlet (5) for flammable gas. The second end (84) of the warming gas tube (75) is capped to prevent any flammable gas from escaping. A warming gas tube support (76) is attached to the lower surface (74) of the upper platform of the (19) of the burner base (1) and fixes the warming gas tube (75) to the burner base (1). The warming gas tube (75) has a threaded hole defined therein facing the lower surface (74) of the upper platform (19) of the burner base (1) and threadably engages a warming gas jet (7). The warming gas jet (7) is positioned between the primary gas jets (6) which are located on the primary gas transfer tube (72).

The top surface (73) of the upper platform (19) of the burner base (1), has an annular groove (77) defined on the periphery of the upper platform (19) to allow an O-Ring (13) to be seated thereon. The O-Ring creates a seal between the upper platform (19) and an appliance (40). The upper platform (19) has a center opening (16) defined therein, wherein the center opening (16) is situated above the primary gas jets (6), and the warming gas jet (7), and is large enough to allow a pair of primary gas/air mixture tubes (29), and one warming gas/air mixture tube (30) to penetrate therethrough. The upper platform (19) of the burner base (1) has a threaded hole defined therein to threadably engage a threaded electrode support (18). The threaded electrode support (18) has a central hole penetrating therethrough to allow an ignition electrode (17) to be slidably located within said threaded electrode support (18) and thereby being able to ignite a flammable gas/air mixture. The upper platform (19) of the burner base (1) has a plurality of threaded holes (21) that are coincident with holes located in the appliance (40).

A burner head assembly (2) consists of a lower burner head (2A), a middle burner head (2B), and an upper burner head (2C).

The lower burner head (2A) being cup-shaped and having a lower surface (85), and an upper surface (89). The lower surface (85) of the lower burner head (2A) has a central boss (86) projecting downwards and rests upon the top surface (73) of the upper platform (19) of the burner base (1). The central boss (86) has a first outer hole (122), a second outer hole (123), and a middle hole (121) positioned in line and defined therein, wherein the first outer hole (122), and the second outer hole (123) each engage the primary gas/air mixture tubes (29), and the middle hole (121) engages the warming gas/air mixture tube (30). The warming gas/air mixture tube (30) can be press fit or threaded into the middle hole (121), and the primary gas/air mixture tubes (29) can be press fit or threaded into the first and second outer hole (122), (123). The lower burner head (2A) has air slots (34A) penetrating therethrough. The lower burner head (2A) additionally has attachment holes (25) defined therein. The lower burner head (2A) has an upper surface (89), the upper surface (89) further having a central cavity (90) defined therein. The central cavity (90) of the lower burner head (2A) communicates with the primary gas/air mixture tubes (29) and allows a flammable gas/air mixture to be transmitted therethrough. The upper surface (89) of the lower burner head (2A) further has a thin annular boss (91) projecting upwards. A flat land (92) is located between the thin annular boss (91) and the central cavity (90) of the lower burner head (2A), and is also located below the upper edge (93) of the thin annular boss (91).

The middle burner head (2B) has an upper surface (94) and a lower surface (95). The upper surface (94) of the middle burner head (2B) is in a parallel relationship to the upper edge (93) of the thin annular boss (91) of the lower burner head (2A). The lower surface (95) of the middle burner head (2B) has an annular boss (96) projecting downwards. The annular boss (96) has material removed to define a central cavity (97). The annular boss (96) further has material removed in a radial direction defining a plurality of primary gas/air outlet chambers (31) wherein the plurality of gas/air outlet chambers (31) are sealed when mated with the central cavity (90) of the upper surface (89) of the lower burner head (2A). A beveled transition area (98) is defined between the annular boss (96) and an outer upwardly projecting surface (99) of the middle burner head (2B). The lower surface (95) of the middle burner head (2B) further has a central hollow boss (100) projecting downwards. The central hollow boss (100) of the middle burner head (2B) provides a gas tight seal with the warming gas/air mixture tube (30) when the middle burner head (2B) is mounted onto the lower burner head (2A). The plurality of primary gas/air outlet chambers (31) communicate with the primary gas/air mixture tubes (29) and allow the flammable gas/air mixture to flow through the plurality of primary gas/air outlet chambers (31), and through a first gap (101) formed between the lower burner head (2A) and the middle burner head (2B). The annular boss (96) has material removed defining air slots (34B), with these air slots (34B) coinciding with the air slots (34A) in the lower burner head (2A). The middle burner (2B) head has attachment holes (26) defined therein, where the attachment holes (26) of the middle burner (2B) are located in line and coincide with the attachment holes (25) of the lower burner head (2A).

The upper burner head (2C) has an upper surface (102), a lower surface (103), and an outer edge (104). A circular boss (105) is located on the lower surface (103) of the upper burner head (2C) and projects downward and creates a gas tight seal between the upper surface (94) of the middle burner head (2B) and the circular boss (105) of the upper burner head (2C). The circular boss (105) of the upper burner head (2C) has material removed from a central location creating a warming gas/air chamber (42) that allows a flammable gas/air mixture from the warming gas/air mixture tube (30) to enter. The circular boss (105) further has material removed in a plurality of radial directions defining a plurality of warming burner gas/air outlet chambers (33), wherein the plurality of warming burner gas/air outlet chambers (33) are sealed when mated with the upper surface (94) of the middle burner head (2B). The upper surface (102) of the upper burner head (2C) has an upturned flange or lip (124) on the outer edge (104) of the upper burner head (2C) that maintains a parallel relationship with the upper surface (94) of the middle burner head (2B) and the upper edge (93) of the thin annular boss (91) of the lower burner head (2A) and creates a second gap (106), the second gap (106) communicating with the warming burner gas/air outlet chambers (33) therebetween allowing the flammable gas/air mixture to pass therethrough. The upper burner head (2C) has a centrally located radial ring (107), the radial ring (107) further having a centrally positioned hollow portion (108). The upper burner head (2C) has a threaded hole (35), the threaded hole (35), being located in the centrally positioned hollow portion (108) of the centrally located radial ring (107) of the upper burner head (2C), the threaded hole (35) threadably engaging a regulating gas jet (15). The threaded hole (35) is centrally located above the warming gas/air mixture tube (30) mounted in the lower burner head (2A). The regulating gas jet (15) allows the flammable gas/air mixture from the warning gas/air chamber (42) to penetrate therethrough to the upper surface (1 02) of the upper burner head (2C). Additional material is removed from the circular boss (105) of the upper burner head (2C) creating air slots (34C) in the upper burner head (2C). The upper burner head (2C) has threaded holes (27) that are co-incident and in line with the attachment holes (26) in the middle burner head (2B), and the attachment holes (25) in the lower burner head (2A). A second set of threaded fasteners (46) are inserted through the holes (25) in the lower burner head (2A), the holes (26) in the middle burner head (2B), and threadably engage the threaded holes (27) located in the upper burner head (2C) creating a tight seal between the upper burner head (2C), the middle burner head (2B), and the lower burner head (2A). The air slots (34A) in the lower burner head (2A), the air slots (34B) in the middle burner head (2B), and the air slots (34C) in the upper burner head (2C) are thereby aligned allowing easy access to a first set of threaded fasteners (14) threadably engaging the plurality of threaded holes (21) in the upper platform (19) of the burner base (1), thereby attaching the burner base (1), and the burner head assembly (2) to the appliance top (40). The aligned air slots (34A), (34B), and (34C) also allow access for easy replacement of the ignition electrode (17), which is slidably inserted from the topside of the burner assembly.

A Burner cap assembly (3) has a centrally positioned warming burner cap (109) and a centrally positioned outer burner ring (110) and is held in position by connecting bridges (39), wherein the connecting bridges (39) attach from an inner surface (111) of the outer burner ring (110), and the outer surface (112) of the warming burner cap (109). The warming burner cap (109) has a lower surface (87). The lower surface (87) of the warming burner cap (109) has material removed to define a first warming burner chamber (43). The warming burner cap (109) has a plurality of holes defining a plurality of inner warming burner ports (44) defining a first warning flame ring (53). The first warming flame ring (53) allows the flammable gas/air mixture to escape from the first warming burner chamber (43) to the outer surface (112) of the warming burner cap (109) where it is ignited creating a warming flame. The outer burner ring (110) has a lower surface (113), the lower surface (113) has a groove forming a second warming gas/air transfer chamber (48), the second warming gas/air transfer chamber (48) being centrally located and positioned so as to communicate with the second gap (106) between the upper burner head (2C), and the middle burner head (2B). The inner surface (111) of the outer burner ring (110) has a plurality of holes defining a middle flame ring (9), the middle flame ring (9) allowing the flammable gas/air mixture from the second gap (106) between the upper burner head (2C), and the middle burner head (2B) to penetrate therethrough. The outer burner ring (110) has a second groove defining a primary gas/air transfer channel (48A), the primary gas/air transfer chamber (48A) being centrally located and positioned so as to communicate with the first gap (101) between the lower burner head (2A), and the middle burner head (2B). The outer burner ring (110) has an outer surface (114), the outer surface (114) having a plurality of holes defining an outer flame ring (11), the outer flame ring (11) allowing the flammable gas/air mixture to exit from the primary gas/air transfer chamber (48A) and to be ignited creating a second warming flame. A thin circular ring (115) is located on the lower surface (113) of the outer burner ring (110) and is located inside the outer surface (114) of the outer burner ring (110). The first warning burner chamber (43) of the burner cap assembly (3) is positioned over the radial ring (107) and positionally locates the burner cap assembly (3) onto the burner head assembly, (2), thus allowing the first warming burner chamber (43) to receive the flammable gas/air mixture from the regulating gas jet (15) located on the upper burner head (2C), allowing the second warming gas/air chamber (48) to communicate with the second gap (106) between the upper burner head (2C), and allowing the middle burner head (2B) and the primary gas/air transfer chamber (48A) to communicate with the first gap (101) between the lower burner head (2A) and the middle burner head (2B). The thin circular ring (115) located on the outer burner ring (110) is then positioned, creating a third gap (116) between the thin annular boss (91) on the upper surface (89) of the lower burner head (2A). The third gap (116) between the thin annular boss (91) on the upper surface (89) of the lower burner head (2A) communicates with the first gap (101) between the lower burner head (2A), and the middle burner head (2B) and allows the flammable gas/air mixture to pass therethrough and exit through a slot or supporting flame ring (41) created between the thin circular ring (115) of the burner cap assembly (3) and the lower burner head (2B). The supporting flame ring (41) provides a sustaining flame for the outer flame ring (11) when ignited preventing inadvertent extinguishing of the main flame.

A hollow tube or ignition gas transfer tube (10) is mounted onto the outer burner ring (110), and has an end one (117), an end two (118), a first gas hole (119), and a second gas hole (120). The first gas hole (119) communicating with the secondary warming gas/air transfer chamber (48) and the second gas hole (120) communicating with the primary gas/air transfer chamber (48A). The first gas hole (119), and the second gas hole (120) allow the flammable gas/air mixture to pass therethrough and transmits an ignition spark from the ignition electrode (17) thereby igniting the flammable gas/air mixture from the outer flame ring (11) and the middle flame ring (9).

Another embodiment of the burner cap (3) is one in which an additional burner ring or second outer burner ring (125) is added . The second outer burner ring (125) has a second main flame ring (52) communicating with the main gas/air transfer chamber (48A) with the second main flame ring (52) facing outwards. The second outer burner ring (125) additionally has a first main flame ring (51) facing inwards towards the warming burner cap (109). The first main flame ring (51) also communicates with the main gas/air transfer chamber (48A).

The outer burner ring (110) has a third warming flame ring (50) facing outwards towards the first main flame ring (51). The outer burner ring (110) additionally has a second warming flame ring (49). The second warming flame ring (49), and the third warming flame ring (50) communicate with the warming gas/air chamber (48).

The warming burner cap(109) has a first warming flame ring (53) with the first warming flame ring (53) facing towards the outer burner ring (110). The first warming flame ring (53) communicates with the first warming burner chamber (43).

The second outer burner ring (125) has mounted thereon a second gas/air transfer channel (47A) wherein the second gas/air transfer channel (47A) communicates with the main gas/air transfer chamber (48A) allowing the flammable gas air mixture to pass therethrough and be ignited by a second ignition electrode (17A). The second ignition electrode is mounted similar to the ignition electrode (17).

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A multi-ring gas burner assembly comprising:

a) a burner base, said burner base having means to support a primary gas transfer tube, said primary gas transfer tube has means to supply flammable gas to a burner head assembly, said burner base having means to support a warming gas tube, said warming gas tube has means to supply flammable gas to said burner head assembly and said burner base has means to support said burner head assembly, with said burner base having means to locate and support an ignition means;

b) said burner head assembly has a lower burner head, a middle burner head, and an upper burner head, said lower burner head being cup-shaped and having a central cavity defined therein, said lower burner head having at least two primary gas/air mixture tubes and at least one warming gas/air mixture tube attached thereon, said middle burner head fitting inside said central cavity creating a first gap therebetween and creating a plurality of primary gas/air outlet chambers, said plurality of primary gas/air outlet chambers communicate with said primary gas/air mixture tubes, said first gap communicating with said plurality of primary gas/air outlet chambers, said upper burner head being mounted onto an upper surface of said middle burner head creating a second gap therebetween, defining a warming burner gas/air chamber and defining a plurality of warming burner gas/air outlet chambers, said warming burner gas/air chamber communicating with said plurality of warming burner gas/air outlet chambers, said upper burner head further having a hole centrally positioned and defined therein, said hole communicating with said warming burner gas/air chamber, said burner head assembly additionally having means to access said ignition means, to access said means to supply flammable gas to said primary gas transfer tubes, and to access said means to supply flammable gas to said warming gas transfer tubes; and c) a burner cap resting on said burner head assembly, said burner cap has a centrally positioned warming burner cap and a centrally positioned outer burner ring with connecting bridges to positionally hold said centrally positioned warming burner cap and said centrally positioned outer burner ring in relationship to each other, said centrally positioned warming burner cap having a warming burner chamber defined therein, said warming burner chamber communicating with said hole in said upper burner head, said centrally positioned warming burner cap further having a plurality of inner warming burner ports defined thereon, said plurality of inner warming burner ports communicating with said warming burner chamber allowing the flammable gas/air mixture to pass therethrough providing a warming flame when ignited, said centrally positioned outer burner ring has a second warming gas/air transfer chamber, said second warming gas/air transfer chamber communicating with said plurality of said warming burner gas/air outlet chambers, said centrally positioned outer burner ring additionally has an inner and an outer surface, said inner surface of said centrally positioned outer burner ring has a plurality holes defined thereon, said plurality of holes defining a middle flame ring, said middle flame ring providing an additional warming flame when ignited, said centrally positioned outer burner ring further has a primary gas/air outlet chamber, said primary gas air outlet chamber communicating with said first gap between said plurality of said primary gas/air outlet chambers, said outer surface of said outer burner ring has a plurality of holes defining an outer flame ring, said outer flame ring providing a main flame when ignited, said outer burner ring and said lower burner head having a third gap defined therebetween, said third gap defining a supporting flame ring.

2. The multi-ring gas burner assembly according to claim 1, in which said means to supply flammable gas to said primary gas transfer tube comprises:

a) at least two primary gas jets, said primary gas jets being threadably attached to said primary gas transfer tube, said primary gas jets being spaced apart, centrally located and positioned below and facing said primary gas/air mixture tubes allowing flammable gas and air to enter therein.

3. The multi-ring gas burner assembly according to claim 1, in which said means to supply flammable gas to said warming gas tube comprises:

a) at least one warming gas jet, said warming gas jet being threadably attached to said warning gas tube, said warming gas jet is additionally positioned between said primary gas jets of said primary gas transfer tube, said warming gas jet is located below and facing said warming gas/air mixture tube allowing flammable gas and air to enter therein.

4. The multi-ring gas burner assembly according to claim 1, wherein:

a) said lower burner head has attachment holes defined therein, said middle burner head has attachment holes defined therein, said attachment holes in said middle burner head being located in line and coinciding with said attachment holes in said lower burner head, said upper burner head has attachment holes defined therein, said attachment holes in said upper burner head being threaded and located in line and coinciding with said attachment holes in said lower burner head and said attachment holes in said upper burner head, threaded fasteners are inserted through said attachment holes in said lower burner head and said middle burner head and said threaded fasteners threadably engage said attachment holes in said upper burner head creating a gas tight seal for said primary gas/air chambers and said warming gas/air chambers.

5. The multi-ring gas burner assembly according to claim 1, wherein:

a) said burner base having an upper platform, said upper platform having an upper surface, said upper surface having a groove defined thereon, an O ring being situated in said groove providing a seal between said burner base and the appliance top, said upper platform of said burner base has a plurality of threaded holes defined therein, said plurality of threaded holes being coincident with holes located in the appliance top, a first set of threaded fasteners threadably engage said plurality of threaded holes in said burner base attaching said burner base, and said burner head to the appliance top.

6. The multi-ring gas burner assembly according to claim 1, wherein:

a) said means to access said ignition means, said means to access said means to supply flammable gas to said primary gas transfer tubes, and said means to access said means to supply flammable gas to said warming gas transfer tubes is a plurality of air slots defined in said burner head assembly.

7. The multi-ring burner assembly according to claim 1, wherein:

a) said hole centrally positioned in said upper burner head threadably engages a regulating gas jet.

8. The multi-ring burner assembly according to claim 1, wherein:

a) said ignition means comprises a threaded electrode support threadably attached to said burner base and located between said warming burner cap and said outer flame ring, an ignition electrode is slidably located in said threaded electrode support.

* * * * *